US009681210B1

(12) United States Patent
Lippert et al.

(10) Patent No.: US 9,681,210 B1
(45) Date of Patent: Jun. 13, 2017

(54) LIQUID-TOLERANT ACOUSTIC DEVICE CONFIGURATIONS

(71) Applicant: Apple Inc., Cupertino, CA (US)

(72) Inventors: Jesse A. Lippert, Cupertino, CA (US); Nikolas T. Vitt, Cupertino, CA (US); Rex T. Ehman, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/563,454

(22) Filed: Dec. 8, 2014

Related U.S. Application Data

(60) Provisional application No. 62/044,902, filed on Sep. 2, 2014.

(51) Int. Cl.
*H04R 1/02* (2006.01)
*G10K 15/00* (2006.01)
*H04R 31/00* (2006.01)

(52) U.S. Cl.
CPC ..... *H04R 1/02* (2013.01); *G10K 15/00* (2013.01); *H04R 31/00* (2013.01)

(58) Field of Classification Search
CPC . H04R 1/02; H04R 1/021; H04R 1/44; H04R 2201/02; H04R 2201/003; H04R 1/1016; H04R 31/00; G10K 15/00
See application file for complete search history.

(56) References Cited

U.S. PATENT DOCUMENTS 3,987,258 A 10/1976 Tsutsui
4,868,799 A 9/1989 Massa
5,117,403 A 5/1992 Eberl et al.
5,349,140 A 9/1994 Valenzin
5,812,496 A 9/1998 Peck
6,007,105 A * 12/1999 Dietle ..... F16L 27/0828 277/559
6,064,909 A 5/2000 Barkley et al.
(Continued)

FOREIGN PATENT DOCUMENTS

CN 1933679 3/2007
EP 1998591 12/2008
(Continued)

OTHER PUBLICATIONS

Consumerist, "Cellphone Battery Designed to Fail at First Drop of Water?" Consumerist, Sep. 22, 2007 (Sep. 22, 2007), XP055199652, Retrieved from the Internet: URL:http://consumerist.com/2007/09/22/cellphone-battery-designed-to-fail-at-first-drop-of-water/ [retrieved on Jul. 2, 2015], 4 pages.
(Continued)

*Primary Examiner* — Mark Fischer
(74) *Attorney, Agent, or Firm* — Brownstein Hyatt Farber Schreck, LLP

(57) ABSTRACT

A liquid-tolerant acoustic device assembly includes a housing with an acoustic aperture connected to a through hole in the housing. An acoustic device such as a microphone or speaker that includes a liquid resistant membrane is coupled to the through hole utilizing a gasket. A protrusion is positioned between the through hole and the gasket. The configuration of the assembly may be tuned such that liquid present in the through hole is allowed to exit and/or functioning of the acoustic device is not impaired by the presence of the liquid in the through hole. The assembly may be incorporated into an electronic device.

20 Claims, 4 Drawing Sheets

(56) References Cited

U.S. PATENT DOCUMENTS

| | | | | |
|---|---|---|---|---|
| 6,128,394 | A | 10/2000 | Hayakawa | |
| 6,486,398 | B1 | 11/2002 | McCulloch | |
| 6,785,395 | B1 | 8/2004 | Arneson | |
| 6,899,794 | B1 | 5/2005 | Yamada | |
| 6,932,187 | B2 | 8/2005 | Banter et al. | |
| 7,245,733 | B2 | 7/2007 | Saltykov | |
| 7,480,209 | B2 | 1/2009 | Giles | |
| 7,499,561 | B2 | 3/2009 | Hanses et al. | |
| 7,577,345 | B2 | 8/2009 | Tei et al. | |
| 7,707,877 | B2 | 5/2010 | Nishizu et al. | |
| 7,876,919 | B2 | 1/2011 | Ram et al. | |
| 7,894,621 | B2 | 2/2011 | Jensen | |
| 8,055,003 | B2 | 11/2011 | Mittleman et al. | |
| 8,059,490 | B2 | 11/2011 | Rapps et al. | |
| 8,112,130 | B2 | 2/2012 | Mittleman et al. | |
| 8,135,149 | B2 | 3/2012 | Yoshida et al. | |
| 8,157,048 | B2 | 4/2012 | Banter et al. | |
| 8,170,266 | B2 | 5/2012 | Hopkinson et al. | |
| 8,175,321 | B2 | 5/2012 | Bryant et al. | |
| 8,185,166 | B2 | 5/2012 | Weber et al. | |
| 8,229,153 | B2 | 7/2012 | Mittleman et al. | |
| 8,233,646 | B2 | 7/2012 | Lutz | |
| 8,272,517 | B2 | 9/2012 | Horie et al. | |
| 8,416,089 | B1 | 4/2013 | Clary | |
| 8,644,530 | B2 | 2/2014 | Soininen et al. | |
| 8,670,586 | B1 | 3/2014 | Boyle et al. | |
| 8,687,828 | B2 | 4/2014 | Otani et al. | |
| 8,724,841 | B2 | 5/2014 | Bright et al. | |
| 8,792,665 | B2 | 7/2014 | Lin | |
| 8,803,745 | B2 | 8/2014 | Dabov | |
| 8,811,634 | B2 | 8/2014 | Kaplan et al. | |
| 8,883,289 | B2 | 11/2014 | Tsao et al. | |
| 8,923,528 | B2 | 12/2014 | Arche | |
| 8,939,252 | B2 | 1/2015 | Sanborn | |
| 8,986,802 | B2 | 3/2015 | Karube et al. | |
| 9,038,773 | B2 | 5/2015 | Banter | |
| 9,171,535 | B2 | 10/2015 | Abe et al. | |
| 9,226,076 | B2 | 12/2015 | Lippert et al. | |
| 9,363,589 | B2 | 6/2016 | Lippert et al. | |
| 2004/0029530 | A1* | 2/2004 | Noguchi | H04R 5/023 455/23 |
| 2005/0134473 | A1* | 6/2005 | Jang | F25D 29/005 340/691.1 |
| 2006/0045301 | A1 | 3/2006 | Jakubaitis | |
| 2006/0198547 | A1 | 9/2006 | Hampton | |
| 2007/0003081 | A1 | 1/2007 | Ram et al. | |
| 2007/0035865 | A1 | 2/2007 | Chashi | |
| 2007/0113964 | A1 | 5/2007 | Crawford et al. | |
| 2007/0263878 | A1 | 11/2007 | Yu | |
| 2008/0149417 | A1 | 6/2008 | Dinh | |
| 2009/0034775 | A1* | 2/2009 | Burton | H04R 1/1016 381/380 |
| 2009/0091879 | A1* | 4/2009 | Lim | B23K 15/085 361/679.01 |
| 2009/0230487 | A1 | 9/2009 | Saitoh et al. | |
| 2011/0013799 | A1 | 1/2011 | Fang et al. | |
| 2011/0255728 | A1 | 10/2011 | Abe et al. | |
| 2011/0261986 | A1* | 10/2011 | Murayama | G01M 3/26 381/332 |
| 2011/0298184 | A1* | 12/2011 | Aurelius | F16J 15/064 277/630 |
| 2012/0177239 | A1 | 7/2012 | Lee | |
| 2012/0195455 | A1* | 8/2012 | Chiba | H04R 1/1091 381/374 |
| 2012/0237074 | A1* | 9/2012 | Aase | H04R 1/1016 381/380 |
| 2013/0170109 | A1 | 7/2013 | Cohen et al. | |
| 2013/0287213 | A1 | 10/2013 | Sekiyama | |
| 2013/0296994 | A1 | 11/2013 | Vaishya | |
| 2013/0333978 | A1* | 12/2013 | Abe | G10K 11/002 181/291 |
| 2014/0044297 | A1 | 2/2014 | Loeppert et al. | |
| 2014/0064546 | A1* | 3/2014 | Szczech | H04R 1/04 381/361 |
| 2014/0083296 | A1 | 3/2014 | Sanders | |
| 2014/0093095 | A1 | 4/2014 | Slotte et al. | |
| 2014/0219646 | A1 | 8/2014 | Hooton et al. | |
| 2014/0254849 | A1 | 9/2014 | Abe et al. | |
| 2014/0369547 | A1 | 12/2014 | Qingshan | |
| 2015/0016648 | A1 | 1/2015 | Kazemzadeh et al. | |
| 2015/0146905 | A1 | 5/2015 | Abe et al. | |
| 2015/0163572 | A1 | 6/2015 | Weiss et al. | |
| 2015/0237431 | A1 | 8/2015 | Jeziorek et al. | |
| 2015/0304767 | A1 | 10/2015 | Mori | |
| 2015/0319534 | A1 | 11/2015 | Lippert et al. | |
| 2016/0205469 | A1 | 7/2016 | Steijner et al. | |
| 2016/0212526 | A1 | 7/2016 | Salvatti et al. | |
| 2017/0041712 | A1 | 2/2017 | Lippert et al. | |

FOREIGN PATENT DOCUMENTS

| | | |
|---|---|---|
| JP | 2004312156 | 11/2004 |
| JP | 2011188191 | 9/2011 |
| JP | 2013115549 | 6/2013 |
| WO | WO 2004/043113 | 5/2004 |
| WO | WO 2011/125804 | 10/2011 |
| WO | WO 2015/047378 | 4/2015 |

OTHER PUBLICATIONS

The Gadget Show, "What to do when gadgets get wet," Retrieved from the Internet: URL:http://gadgetshow.channe15.com/gadget-show/blog/what-to-do-when-gadgets-get-wet [retrieved on Apr. 9, 2014], p. 2, paragraph 1, 2 pages.

Nakano et al., "Helmholtz resonance technique for measuring liquid volumes under micro-gravity conditions," Microgravity Sci. Technol., XVII-3, 2005, pp. 64-70.

* cited by examiner

LIQUID-TOLERANT ACOUSTIC DEVICE CONFIGURATIONS

CROSS-REFERENCE TO RELATED APPLICATION

This application claims the benefit under 35 U.S.C. §119 (e) of U.S. Provisional Patent Application No. 62/044,902, filed Sep. 2, 2014, entitled "Liquid Tolerant Acoustic Device Configurations," which is incorporated by reference as if fully disclosed herein.

TECHNICAL FIELD

This disclosure relates generally to acoustic devices such as microphones and speakers, and more specifically to a liquid-tolerant acoustic device configuration.

BACKGROUND

Many electronic devices include acoustic devices such as microphones or speakers in order to record sound, output sound, and/or perform other functions. Many acoustic devices may include components that are sensitive to damage or impaired operation by exposure to liquids such as water. Such acoustic devices may be isolated in an electronic device from exposure to liquids from the external environment. However, in order to function many acoustic devices included in electronic device may require a through hole to an acoustic aperture of an electronic device that may expose the acoustic device to liquids from the external environment.

In some cases, acoustic devices may include a liquid resistant membrane separating the acoustic device from such a through hole. Such a liquid resistant membrane may allow sound waves to pass through but may restrict the passage of liquids present in the through hole. However, liquid present in the through hole may exert hydrostatic pressure on the liquid resistant membrane such that the liquid resistant membrane tears (allowing liquid into the acoustic device) and/or is restricted from vibrating such that sound waves are restricted from passing through and acoustic device operation is impaired.

Further, once liquid is present in the through hole, surface tension of the liquid and/or other pressures may restrict the ability of the liquid to exit. This phenomenon may exacerbate issues caused by entry of the liquid into the through hole.

SUMMARY

The present disclosure describes systems, methods, and apparatuses related to liquid-tolerant acoustic device configurations. A liquid-tolerant acoustic device assembly may include a housing with an acoustic aperture connected to a through hole in the housing. An acoustic device such as a microphone or speaker including a liquid resistant membrane may be coupled to the through hole using a gasket and/or other sealing mechanism. One or more protrusions may be positioned between the through hole and the gasket. Such a protrusion may reduce and/or eliminate undercut space between the gasket and the through hole. The configuration of the assembly may be tuned such that liquid present in the through hole is allowed to exit and/or functioning of the acoustic device is not impaired by the presence of the liquid in the through hole.

In various implementations, a liquid-tolerant acoustic device assembly may have a housing with an acoustic aperture connected to a through hole in the housing; an acoustic device including a liquid resistant membrane; a gasket coupling the acoustic device to the through hole; and a protrusion positioned between the through hole and the gasket.

In some implementations, a method for producing a liquid-tolerant acoustic device assembly may include: coupling an acoustic device to a through hole in a housing to an acoustic aperture using a gasket; positioning a protrusion between the through hole and the gasket; and tuning the protrusion and the through hole to acoustic properties of the acoustic device or such that surface tension of liquid present in the through hole allows the liquid to exit.

In one or more implementations, an electronic device may include a housing with an acoustic aperture connected to a through hole that leads through the housing; an acoustic device including a liquid resistant membrane; a gasket coupling the acoustic device to the through hole; and a protrusion positioned between the through hole and the gasket.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

Figure 1:
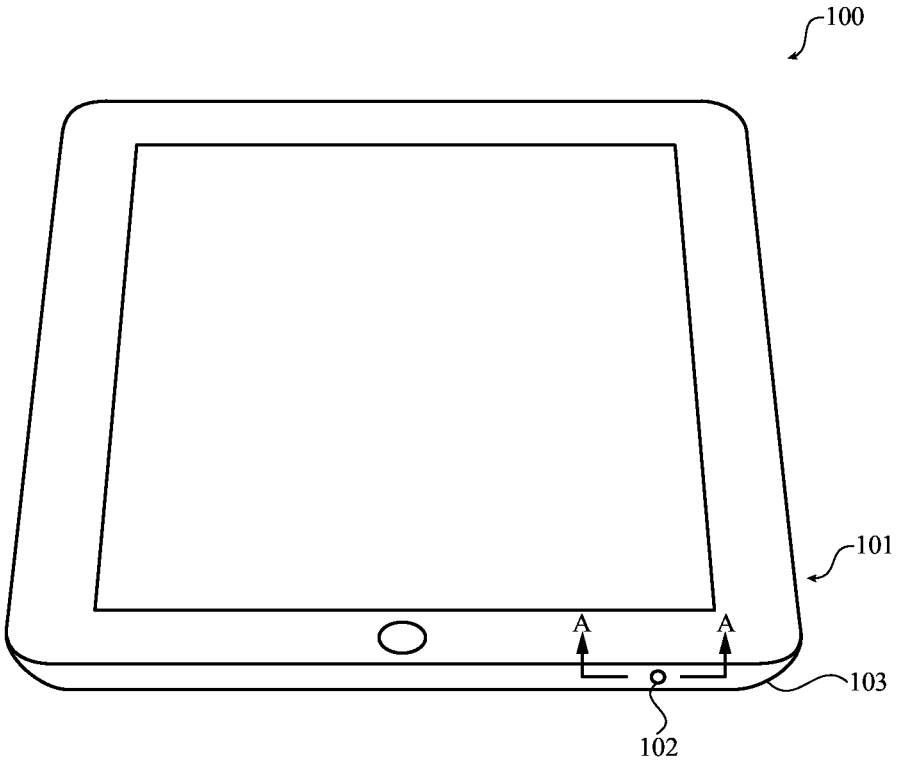
FIG. 1 is a perspective view of an example system including a liquid-tolerant acoustic device.

The description that follows includes sample systems, methods, and apparatuses that embody various elements of the present disclosure. However, it should be understood that the described disclosure may be practiced in a variety of forms in addition to those described herein.

The present disclosure describes systems, methods, and apparatuses related to liquid-tolerant acoustic device configurations. A liquid-tolerant acoustic device assembly may include a housing with an external acoustic aperture connected to a through hole in the housing to an acoustic device (such as a microphone or speaker) including a liquid resistant membrane, a gasket (such as an o-ring) and/or other sealing mechanism coupling the acoustic device to the through hole, and a protrusion positioned between the through hole and the gasket. The protrusion may reduce and/or eliminate space between the gasket and the through hole, such as an undercut. The configuration of the assembly may be tuned such that liquid present in the through hole is allowed to exit and/or functioning of the acoustic device is not impaired by the presence of the liquid in the through hole. The assembly may be incorporated into an electronic device.

The configuration of the assembly may be tuned such that liquid present in the through hole is allowed to exit and/or functioning of the acoustic device is not impaired by the presence of the liquid in the through hole utilizing a variety of different factors. Such factors may include a distance between walls of the through hole or the protrusion; angle of walls of the through hole or the protrusion; volume of an area the protrusion, the liquid resistant membrane, and/or the through hole; distance between a surface of the protrusion facing the liquid resistant membrane and the liquid resistant membrane; size of a gap between a surface of the protrusion facing the liquid resistant membrane and the liquid resistant membrane; a distance between the through hole and the acoustic aperture; and/or other geometries of components of the assembly.

In some implementations, the protrusion may be a portion of the housing that extends beyond the through hole. In other implementations, the protrusion may be another component. In still other implementations, the protrusion may instead be a portion of the gasket that includes one or more surfaces contiguous with the through hole. In one or more implementations, the protrusion, the through hole, and/or the acoustic aperture may include one or more chamfered edges.

In various implementations, the liquid resistant membrane may be expanded polytetrafluoroethylene. In some implementations, the acoustic device may be coupled to the liquid resistant membrane by a stiffener that resists flexing of the acoustic device under pressure, such as hydrostatic pressure, pressure caused by clamping during manufacture of the assembly, and so on. In one or more implementations, the assembly may include one or more coatings on one or more surfaces of the liquid resistant membrane, the protrusion, the through hole, or the acoustic aperture. Such coatings may be hydrophobic, hydrophilic, and/or oleophobic. Surfaces of the protrusion, the through hole, and/or the acoustic aperture may be polished.

FIG. 1 is a perspective view of an example system 100 including a liquid-tolerant acoustic device configuration. As illustrated, the example system may include an electronic device 101 that has a housing 103 and an acoustic aperture 102.

Although the electronic device 101 is illustrated as a tablet computer, it is understood that this is an example. In various implementations the electronic device may be any kind of electronic device that includes an acoustic device such as a microphone, speaker, and/or other acoustic device. Sample electronics device may include a laptop computer, a desktop computer, a fitness monitor, a wearable device, a mobile computer, a cellular telephone, a smart phone, a display, an electronic kitchen appliance, a digital media player, a standalone acoustic device such as a speaker or microphone, and/or any other electronic device.

The electronic device may include a number of components that are not shown. Such components may include one or more processing units, one or more attachment mechanisms, one or more communication components, one or more input/output components, one or more batteries, one or more power adapters, and/or one or more non-transitory storage media (which may take the form of, but is not limited to, a magnetic storage medium; optical storage medium; magneto-optical storage medium; read only memory; random access memory; erasable programmable memory; flash memory; and so on).

Figure 2A:
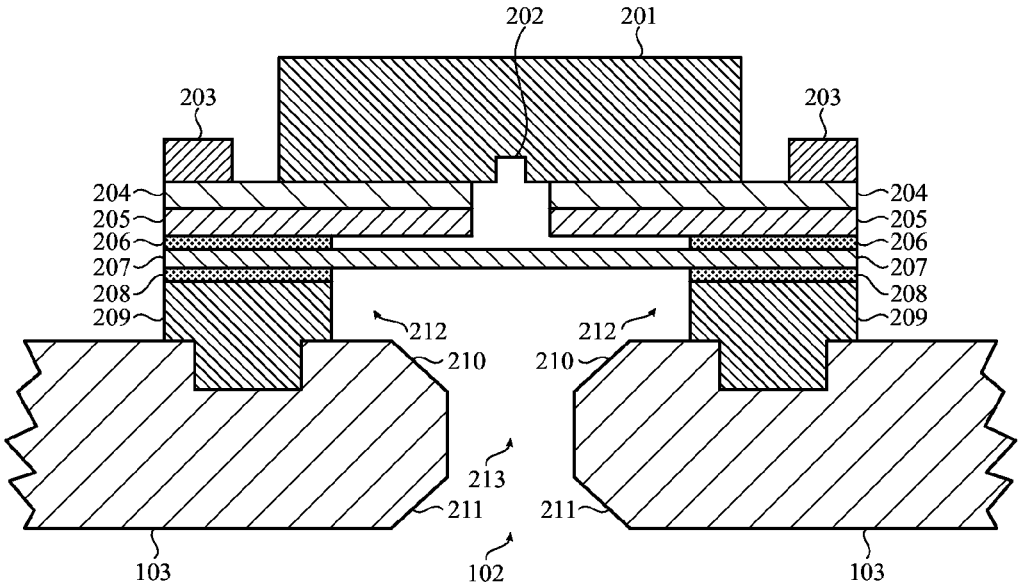
FIG. 2A is a cross sectional view of a first implementation of a liquid-tolerant acoustic device configuration that may be utilized in the example system of FIG. 1, taken along line A-A of FIG. 1.

FIG. 2A is a cross sectional view of a first implementation of a liquid-tolerant acoustic device configuration that may be utilized in the example system 100 of FIG. 1, taken along line A-A of FIG. 1. As illustrated, an acoustic device 201, such as a microphone or speaker, may be coupled to the acoustic aperture 102 via a through hole 213. A gasket 209, such as a silicone and/or other rubber o-ring, may be coupled around the through hole. A liquid resistant membrane 207, such as expanded polytetrafluoroethylene, may be bonded to the gasket by adhesive 208 (such as pressure sensitive adhesive). The liquid resistant membrane may be bonded by adhesive 206 to a stiffener 205, which may be in turn coupled to a substrate 204 (such as a printed circuit board) to which the acoustic device is attached. The acoustic device may be at least partially surrounded by a bracket 203 that may be utilized in manufacturing the acoustic device configuration.

As illustrated, an undercut 212 may be formed between the through hole 213 and the gasket 209, primarily bounded by the gasket 209, the water resistant membrane 207, and the area of the housing 103 between the through hole and the gasket and being open on one side (i.e., the through hole). The undercut may be formed of an internal portion of the housing 103 positioned between the through hole and the gasket. Liquid may enter via the through hole and flow into the undercut. Surface tension of the liquid with the housing may make the liquid difficult to remove. This may prevent exit of the liquid and/or impaired operation of the acoustic device 201 by tearing the liquid resistant (i.e., liquid resistant or liquid proof) membrane and/or exerting force on the liquid resistant membrane such that movement or vibration is prevented. To minimize or reduce liquid retention, the through hole may include chamfered surfaces 210 that reduce the size of the undercut and thus reduce surface tension of the liquid, allowing the liquid to exit and preventing impaired operation of the acoustic device and/or tearing of the liquid resistant membrane. As illustrated, edges 211 of the acoustic aperture 102 may also be chamfered.

The acoustic device 201 may include an acoustic port 202. As illustrated, the substrate 204 and the stiffener may have gaps therein to accommodate the acoustic port. As also illustrated, a moveable area of the liquid resistant membrane (e.g., the area between the portion of the liquid resistant membrane bonded to the adhesives 206 and 208) may be wider than the width of the acoustic port, the through hole 213, and/or the acoustic aperture 102. Such a configuration may enhance or maximize the ability of the liquid resistant membrane to pass sound waves.

The stiffener 205 may be formed of a material such as steel, polyethylene terephthalate, and/or any other such material with suitable or similar stiffening properties. The stiffener may prevent the acoustic device 201 and/or the substrate 204 from flexing, bending, and/or otherwise moving excessively, or at all, in response to pressure (such as hydrostatic pressure, pressure caused by clamping during manufacture, and so on) such that the acoustic device and/or substrate are damaged and/or caused to partially or fully separate from each other and/or other components.

Figure 2B:
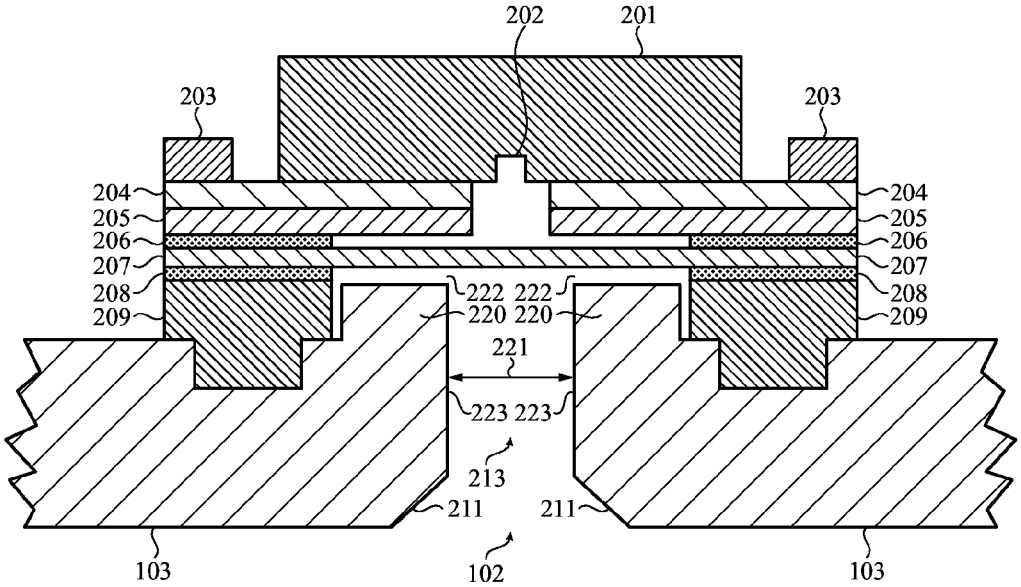
FIG. 2B is a cross sectional view of a second implementation of a liquid-tolerant acoustic device configuration that may be utilized in the example system of FIG. 1, taken along line A-A of FIG. 1.

FIG. 2B is a cross sectional view of a second implementation of a liquid-tolerant acoustic device configuration that may be utilized in the example system 100 of FIG. 1, taken along line A-A of FIG. 1. As compared to the first implementation of FIG. 2A, the sidewalls of the through hole 213 extends beyond the through hole to form a protrusion 220 between the through hole 213 and the gasket 209. Such protrusion may further reduce the undercut 212 as compared to the chamfered surfaces 210 of the first implementation. As such, surface tension of liquid entering the through hole may be reduced, allowing the liquid to exit and preventing impaired operation of the acoustic device 201 and/or tearing of the liquid resistant membrane 201. Further, as a result of this configuration the protrusion and/or the through hole may function as a Hemholtz resonator such that the acoustic device may still be able to operate without significant impairment even though liquid is present.

Various components such as the protrusion 220 and the through hole 213 may be tuned such that liquid that enters the through hole is allowed to exit and/or is not prevented from exiting due to surface tension of the liquid, does not significantly interfere with operation of the acoustic device 201 and/or the liquid resistant membrane 207 (such as by preventing or reducing focusing of hydrostatic pressure of the liquid on the liquid resistant membrane), and/or does not damage the liquid resistant membrane. Factors involved in such tuning may include configuring distance 221 between walls of the through hole or walls of the protrusion; angles of walls of the through hole or walls 223 (or surfaces) of the protrusion (with respect to the liquid, such as whether such walls are convex, concave, and so on); the volume of an area defined by the protrusion, the liquid resistant membrane, the gasket 209, and/or the through hole; distances between a surface of the protrusion facing the liquid resistant membrane and the liquid resistant membrane (i.e., the gap 222 if present) and/or the through hole and the acoustic aperture 102; the size of the gap between the surface of the protrusion facing the liquid resistant membrane and the liquid resistant membrane; and/or other geometries of components of the assembly.

For example, a distance 221 between walls of the through hole or walls of the protrusion 220 may be configured as approximately between 1-1.1 millimeters (such as 1.05 millimeters) in one example implementation. However, it is understood that this is an example and that any distance may be configured without departing from the scope of the present disclosure.

The surfaces of walls 223 of the protrusion 220 and/or the through hole may also be polished in some implementations. Such polishing may increase the ability of liquid to exit the through hole.

As illustrated, the protrusion 220 is illustrated as a portion of the housing 103. However, in various implementations the protrusion may be a separate component from the housing and may be coupled to the housing. In some cases, the protrusion may be a portion of the gasket 209 and may thus not be positioned between the through hole 213 and the gasket. As also illustrated, walls 223 or surfaces of the protrusion may be contiguous with those of the though hole. However, it is understood that this is an example and that other configurations are possible without departing from the scope of the present disclosure.

Further, in some implementations one or more surfaces of the protrusion 220 may be chamfered like the surface 210 of the through hole 213 in FIG. 2A. For example, in various implementations the edge of the protrusion between the walls 213 and the surface facing the liquid resistant membrane 207 may be chamfered.

Figure 2C:
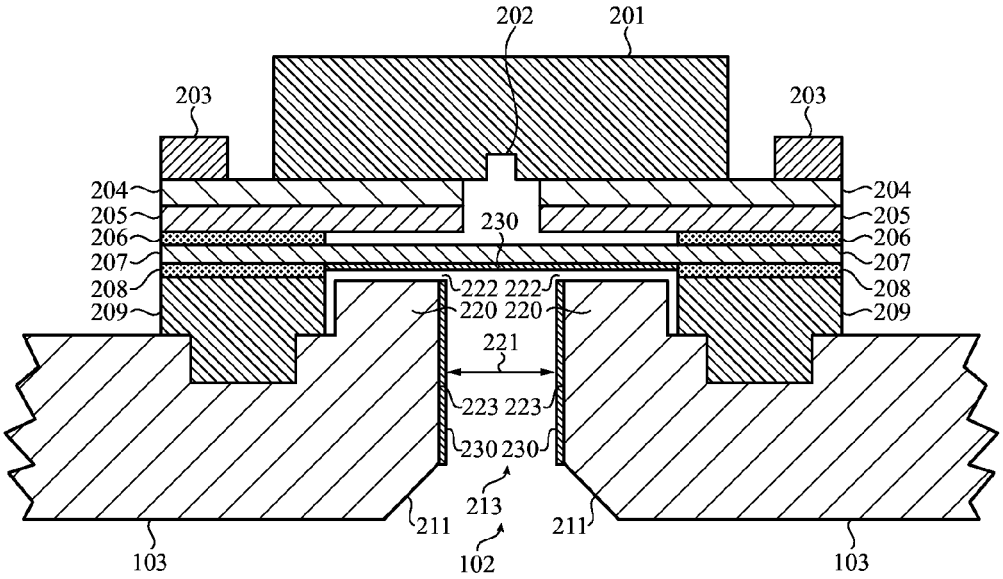
FIG. 2C is a cross sectional view of a third implementation of a liquid-tolerant acoustic device configuration that may be utilized in the example system of FIG. 1, taken along line A-A of FIG. 1.

FIG. 2C is a cross sectional view of a third implementation of a liquid-tolerant acoustic device configuration that may be utilized in the example system of FIG. 1, taken along line A-A of FIG. 1. As compared to the first implementation of FIG. 2B, the second implementation includes one or more coatings 230.

The coatings 230 may be one or more different kinds of coatings such as hydrophobic coatings, oleophobic coatings, hydrophilic coatings, other kinds of coatings, and/or a combination thereof. Such coatings may be positioned on the protrusion 220, the through hole 213, the acoustic aperture 102, the liquid resistant membrane 207, and/or various other components.

For example, a hydrophobic coating 230 may be positioned on the protrusion 220, the through hole 213, and the liquid resistant membrane 207. Such a coating may aid in allowing liquid that enters the through hole to exit.

As illustrated in FIG. 2B, the surface of the protrusion 220 facing the liquid resistant membrane 207 does not contact the liquid resistant membrane but is instead separated by a gap 222. As shown, the protrusion also is separated from the gasket 209. However, it is understood that this is an example and that in various implementations the protrusion may contact the liquid resistant membrane, the gasket, and/or other components that the protrusion is not shown contacting. Various configurations as possible and contemplated.

Figure 2D:
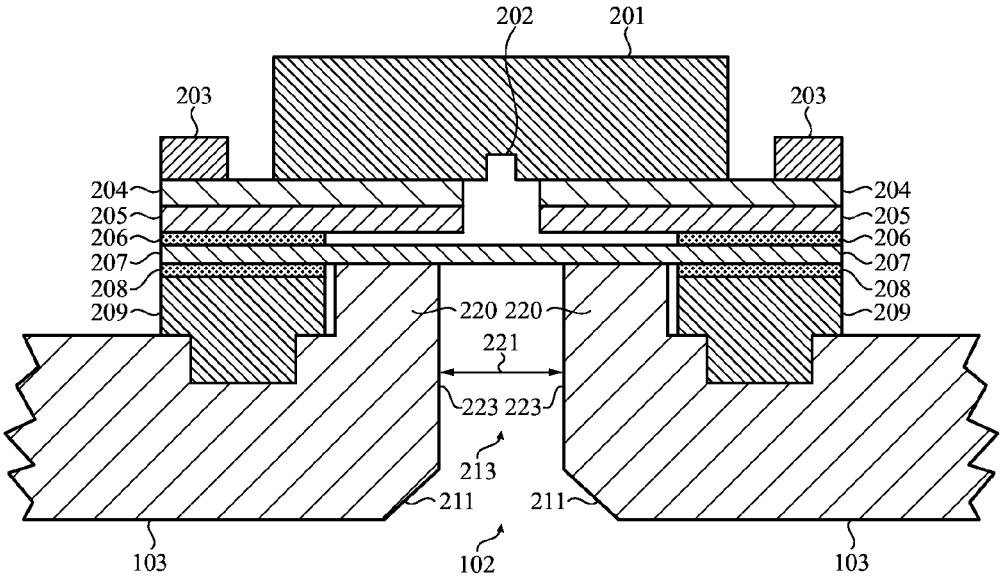
FIG. 2D is a cross sectional view of a fourth implementation of a liquid-tolerant acoustic device configuration that may be utilized in the example system of FIG. 1, taken along line A-A of FIG. 1.

For example, FIG. 2D is a cross sectional view of a fourth implementation of a liquid-tolerant acoustic device configuration that may be utilized in the example system 100 of FIG. 1, taken along line A-A of FIG. 1. As compared with the second implementation shown in FIG. 2B, this fourth implementation positions the protrusion 220 such that the protrusion contacts the liquid resistant membrane 107.

Figure 3:
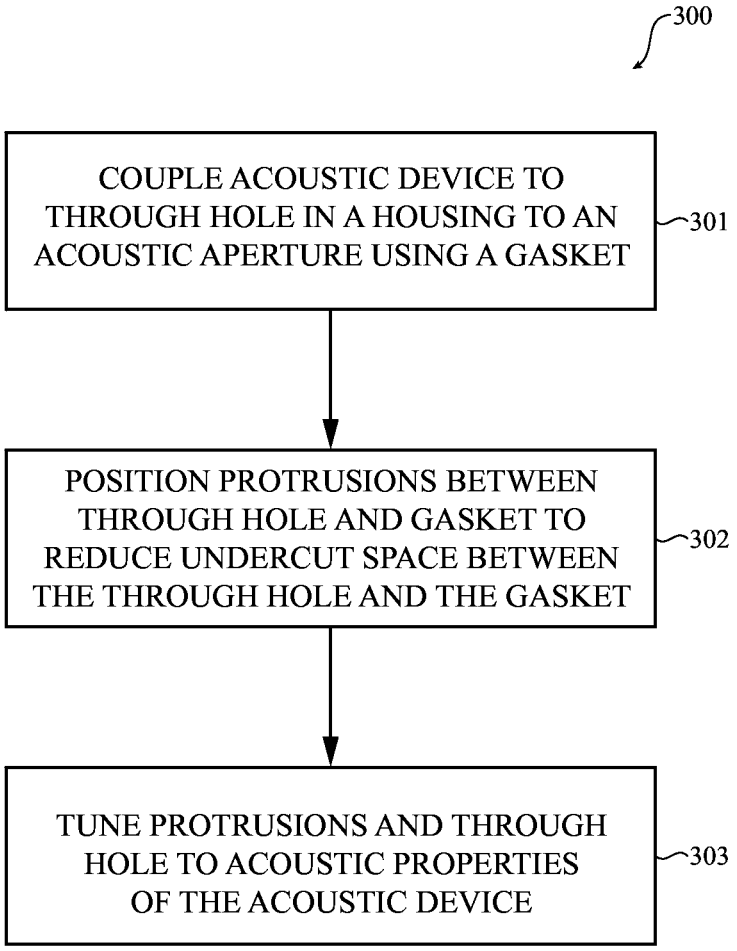
FIG. 3 is a flow chart illustrating an example method for producing a liquid-tolerant acoustic device assembly. This method may produce the example systems of FIGS. 1-2D.

FIG. 3 is a flow chart illustrating an example method for producing a liquid-tolerant acoustic device assembly. This method may be produce the example systems of FIGS. 1-2D.

The flow may begin at block 301 where an acoustic device may be coupled to a through hole in a housing to an acoustic aperture in an external surface of the housing using a gasket. The flow may then proceed to block 302 where one or more protrusions may be positioned between the through hole and the gasket to reduce and/or eliminate undercut space between the through hole and the gasket. Such a protrusion may be a portion of the housing that projects beyond the through hole and/or another component.

Next, the flow may proceed to block 303 where the protrusions and/or the through hole (and/or other components of the assembly) may be tuned to acoustic properties of the acoustic device, such that the acoustic device is capable of operation without significant impairment when liquid is present in the through hole, and/or such that surface tension of the liquid present in the through hole allows the liquid to exit. Such tuning may include configuring dimensions and/or geometries of the protrusions, the through hole, and/or other components; applying coatings to and/or polishing and/or otherwise altering various surfaces of the assembly, and so on.

Although the method 300 is illustrated and described above as including particular operations performed in a particular order, it is understood that this is an example. In various implementations, various orders of the same, similar, and/or different operations may be performed without departing from the scope of the present disclosure.

For example, block 302 is illustrated and described as positioning one or more protrusions between the through hole and the gasket to reduce and/or eliminate undercut space between the through hole and the gasket. However, in various implementations the protrusion may be a portion of the gasket positioned to reduce and/or eliminate undercut space between the gasket and the through hole. Thus, in such implementations the protrusion may not be positioned between the gasket and the through hole. Various configurations are possible and contemplated without departing from the scope of the present disclosure.

By way of another example, block 301 is illustrated and described as coupling the acoustic device to the through hole using a gasket. However, it is understood that this is an example. In various implementations, sealing mechanisms other than a gasket may be utilized instead of and/or in addition to a gasket without departing from the scope of the present disclosure.

As described above and illustrated in the accompanying figures, the present disclosure describes systems, methods, and apparatuses related to liquid-tolerant acoustic device configurations. A liquid-tolerant acoustic device assembly may include a housing with an acoustic aperture connected to a through hole in the housing, an acoustic device (such as a microphone or speaker) including a liquid resistant membrane, a gasket (such as an o-ring) and/or other sealing mechanism coupling the acoustic device to the through hole, and a protrusion positioned between the through hole and the gasket. The protrusion may reduce and/or eliminate undercut space between the gasket and the through hole. The configuration of the assembly may be tuned such that liquid present in the through hole is allowed to exit and/or functioning of the acoustic device is not impaired by the presence of the liquid in the through hole. The assembly may be incorporated into an electronic device.

In the present disclosure, the methods disclosed may be implemented using sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

Techniques discussed in the present disclosure may be implemented utilizing a computer program product, or software, that may include a non-transitory machine-readable medium having stored thereon instructions, which may be used to program a computer system (or other electronic devices) to perform a process according to the present disclosure such as a computer controlled manufacturing process. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. A liquid-tolerant acoustic device assembly, comprising:
- a housing with an acoustic aperture connected to a through hole in the housing, the housing defining a recess;
- an acoustic device;
- a liquid resistant membrane coupled to the acoustic device;
- a gasket coupling the acoustic device to the through hole, the gasket comprising:
  - a first region having a first thickness; and
  - a second region having a second thickness greater than the first thickness; and
- a protrusion positioned between the through hole and the gasket; wherein
- the first region is positioned in the recess and the second region projects above the recess;
- the protrusion and the second region cooperate to form a first gap directly between the protrusion and the second region;
- the housing is continuous between the protrusion and the gasket;
- the protrusion and the gasket do not contact one another; and
- the protrusion and the liquid resistant membrane cooperate to form a second gap directly between the protrusion and the liquid resistant membrane.

2. The acoustic device assembly of claim 1, wherein the protrusion and the through hole are tuned such that at least one of:
- surface tension of liquid present in the through hole allows the liquid to exit;
- hydrostatic pressure of the liquid is not focused on the liquid resistant membrane;
- the acoustic device is able to operate while the liquid is present in the through hole; or
- the protrusion and the through hole function as a Hemholtz resonator.

3. The acoustic device assembly of claim 2, wherein the protrusion and the through hole are tuned by configuring at least one of:
- a distance between walls of the through hole;
- a distance between walls of the protrusion;
- an angle of the walls of the through hole;
- an angle of the walls of the protrusion;
- a volume of an area defined by at least one of the protrusion, the liquid resistant membrane, and the through hole;
- a distance between a surface of the protrusion facing the liquid resistant membrane and the through hole;

a size of a gap between the surface of the protrusion facing the liquid resistant membrane and the liquid resistance membrane; or a distance between the through hole and the acoustic aperture.

4. The acoustic device assembly of claim 1, further comprising a gap between the protrusion and the liquid resistant membrane.

5. The acoustic device assembly of claim 1, wherein the gasket separates the acoustic device from the housing.

6. The acoustic device assembly of claim 1, wherein an edge of the protrusion is chamfered.

7. The acoustic device assembly of claim 1, wherein the liquid resistant membrane separates the acoustic device from the housing.

8. The acoustic device assembly of claim 1, wherein a moveable area of the liquid resistant membrane is wider than at least one of an acoustic port of the acoustic device, a distance between walls of the through hole, or a distance between walls of the protrusion.

9. The acoustic device assembly of claim 1, wherein the liquid resistant membrane comprises expanded polytetrafluoroethylene.

10. The acoustic device assembly of claim 1, wherein the gasket comprises an o-ring.

11. The acoustic device assembly of claim 1, wherein a surface of the through hole is polished.

12. The acoustic device assembly of claim 1, wherein a surface of the protrusion is contiguous with a surface of the through hole.

13. The acoustic device assembly of claim 1, wherein a surface of the protrusion is polished.

14. The acoustic device assembly of claim 1, further comprising at least one of:

a hydrophobic coating positioned on at least one of the protrusion, the through hole, the acoustic aperture; or the liquid resistant membrane;

an oleophobic coating positioned on at least one of the protrusion, the through hole, the acoustic aperture; or the liquid resistant membrane; or a hydrophilic coating positioned on at least one of the protrusion, the through hole, the acoustic aperture; or the liquid resistant membrane.

15. The acoustic device assembly of claim 1, wherein the protrusion is a portion of the housing.

16. The acoustic device assembly of claim 1, further comprising a stiffener coupling the acoustic device to the liquid resistant membrane.

17. The acoustic device assembly of claim 16, wherein the stiffener resists flexing of the acoustic device under pressure.

18. The acoustic device assembly of claim 1, wherein the acoustic device is at least one of a microphone or a speaker.

19. An electronic device, comprising:

a housing with an acoustic aperture connected to a through hole that leads through the housing, the housing defining a recess;

an acoustic device including a liquid resistant membrane;

a gasket coupling the acoustic device to the through hole, the gasket comprising:

a first region having a first thickness; and a second region having a second thickness greater than the first thickness; and a protrusion positioned between the through hole and the gasket; wherein the first region is positioned in the recess and the second region projects above the recess;

the protrusion and the second region cooperate to form a first gap directly between the protrusion and the second region;

the housing is continuous between the protrusion and the gasket;

the protrusion and the gasket do not contact one another; and the protrusion and the liquid resistant membrane cooperate to form a second gap directly between the protrusion and the liquid resistant membrane.

20. A method for producing a liquid-tolerant acoustic device assembly, comprising:

coupling an acoustic device to a through hole in a housing to an acoustic aperture using a gasket, the housing defining a recess, the gasket comprising:

a first region having a first thickness, the first region positioned in the recess; and a second region having a second thickness greater than the first thickness, the second region projecting above the recess;

positioning a protrusion between the through hole and the second region to define a first gap directly between the protrusion and the second region and a second gap between the protrusion and a liquid resistant membrane coupled to the acoustic device wherein the protrusion and the gasket do not contact one another and the housing is continuous between the protrusion and the gasket; and tuning the protrusion and the through hole to acoustic properties of the acoustic device or such that surface tension of liquid present in the through hole allows the liquid to exit.

* * * * *